US008853143B2

(12) United States Patent
Fellows

(10) Patent No.: US 8,853,143 B2
(45) Date of Patent: Oct. 7, 2014

(54) WET WIPE

(75) Inventor: Adrian Neville Fellows, West Yorkshire (GB)

(73) Assignee: Gama Healthcare Limited, London (GB)

( * ) Notice: Subject to any disclaimer, the term of this patent is extended or adjusted under 35 U.S.C. 154(b) by 0 days.

(21) Appl. No.: 13/272,366

(22) Filed: Oct. 13, 2011

(65) Prior Publication Data

US 2013/0081219 A1 Apr. 4, 2013

(30) Foreign Application Priority Data

Sep. 29, 2011 (GB) ..... 1116765.7

(51) Int. Cl.

| | |
|---|---|
| ***C11D 1/75*** | (2006.01) |
| ***C11D 3/22*** | (2006.01) |
| ***C11D 3/43*** | (2006.01) |
| ***C11D 1/66*** | (2006.01) |
| ***C11D 3/20*** | (2006.01) |
| ***C11D 3/50*** | (2006.01) |
| ***C11D 3/30*** | (2006.01) |
| ***C11D 3/48*** | (2006.01) |
| ***C11D 17/04*** | (2006.01) |

(52) U.S. Cl.

CPC ..... *C11D 1/662* (2013.01); *C11D 3/2068* (2013.01); *C11D 1/75* (2013.01); *C11D 3/50* (2013.01); *C11D 3/30* (2013.01); *C11D 3/222* (2013.01); *C11D 3/48* (2013.01); *C11D 17/043* (2013.01); *C11D 17/049* (2013.01)

USPC ..... 510/438; 510/238; 510/295; 510/383; 510/470; 510/499; 510/503; 510/505; 510/506

(58) Field of Classification Search

CPC ..... C11D 1/662; C11D 1/75; C11D 3/2068; C11D 3/222; C11D 3/30; C11D 3/48; C11D 3/50; C11D 17/043

USPC ..... 510/101, 238, 295, 383, 438, 470, 499, 510/504, 505, 506, 503

See application file for complete search history.

(56) References Cited

U.S. PATENT DOCUMENTS

| | | | | |
|---|---|---|---|---|
| 4,488,981 | A * | 12/1984 | Urfer et al. | 510/405 |
| 5,045,116 | A | 9/1991 | Cohen | |
| 6,083,893 | A | 7/2000 | Zint et al. | |
| 6,432,904 | B1 * | 8/2002 | Suazon et al. | 510/438 |
| 6,569,828 | B1 * | 5/2003 | Thomas et al. | 510/438 |
| 6,613,732 | B2 * | 9/2003 | Suazon et al. | 510/438 |
| 6,841,527 | B2 * | 1/2005 | Mitra et al. | 510/295 |
| 7,345,015 | B1 * | 3/2008 | Kong et al. | 510/295 |
| 2003/0100465 | A1 | 5/2003 | Kilkenny et al. | |
| 2004/0087460 | A1 * | 5/2004 | Wisniewski et al. | 510/296 |
| 2004/0092419 | A1 * | 5/2004 | Connor et al. | 510/327 |
| 2005/0215458 | A1 * | 9/2005 | Lalum et al. | 510/438 |
| 2005/0215459 | A1 * | 9/2005 | Policicchio et al. | 510/438 |
| 2005/0229327 | A1 * | 10/2005 | Casella et al. | 8/115.51 |
| 2007/0037721 | A1 * | 2/2007 | Michels et al. | 510/295 |
| 2007/0142261 | A1 * | 6/2007 | Clark et al. | 510/438 |
| 2008/0010772 | A1 | 1/2008 | Kong et al. | |
| 2008/0128003 | A1 * | 6/2008 | Ochomogo et al. | 134/34 |
| 2008/0145267 | A1 * | 6/2008 | Do et al. | 422/5 |

FOREIGN PATENT DOCUMENTS

| | | | |
|---|---|---|---|
| DE | 10301839 | A1 | 7/2004 |
| EP | 0604996 | A2 | 7/1994 |
| JP | 1314546 | A | 12/1989 |
| JP | 9255993 | A | 9/1997 |
| NZ | 538267 | A | 9/2007 |
| WO | 2004058214 | A1 | 7/2004 |
| WO | 2004067693 | A2 | 8/2004 |
| WO | 2005037981 | A1 | 4/2005 |
| WO | 2005046890 | A1 | 5/2005 |
| WO | 2007101445 | A1 | 9/2007 |
| WO | 2010101864 | A1 | 9/2010 |

OTHER PUBLICATIONS

Dec. 21, 2012 UK Search Report for corresponding Application No. GB1116765.7.

* cited by examiner

*Primary Examiner* — Gregory R Delcotto
(74) *Attorney, Agent, or Firm* — Egbert Law Offices, PLLC

(57) ABSTRACT

A wet wipe is provided suitable for use in cleaning surfaces in a healthcare environment that leaves a smear-free or substantially smear-free finish. The wipe comprises a substrate that has been impregnated with a cleaning composition which comprises an aqueous alkyl glucoside and/or alkyl polyglucoside mixture. The alkyl glucoside and/or alkyl polyglucoside is present in any amount between 0.01% w/v and 4.00% w/v inclusive. Preferably, the substrate comprises a non-woven material that is binder free.

7 Claims, No Drawings

WET WIPE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a wet wipe and in particular, but not exclusively, to a wet wipe that leaves a smear-free or substantially smear-free finish and that is suitable for use in cleaning a wide range of surfaces in a healthcare environment.

2. Description of Related Art Including Information Disclosed Under 37 CFR 1.97 and 37 CFR 1.98

When it is desired to clean environmental surfaces and items of equipment the cleaning process may be achieved by a variety of physical and/or chemical procedures. Chemical means of cleaning include the use of water, organic solvents, acids and alkalis and a wide range of detergents or surfactants. Physical assistance to the cleaning task may be achieved by wiping, rubbing, high pressure jetting, ultrasonics, heat or other means. Combination treatments involve many familiar product combinations, for example detergents in combination with sponges, woven and nonwoven wipes, pressure washing machines, ultrasonic baths, washing machines, and many others. Many items require to be cleaned in a manner that involves objectives beyond the simple removal of existing soil. It may be necessary to leave a substantially smear-free finish, as with window glass, or to clean and disinfect, or to clean without causing corrosion or other deleterious effect to sensitive items or parts, or to clean in a manner that has no adverse environmental effects. The present invention is particularly, but not exclusively, concerned with the cleaning of surfaces in a healthcare environment where it is necessary both to clean in an effective manner and to leave a smear-free or substantially smear-free finish so that the surfaces appear clean.

There are many cleaning compositions that leave a smear-free finish. Usually, this is achieved by using solvents that evaporate leaving no residue. Effective cleaning can therefore be achieved if these are used in combination with a wipe, sponge or other similar product that can physically remove any surface soiling. Known solvents include water, alcohol, aromatic solvents, petroleum spirit, ammonia, ammonium hydroxide, and acetic acid and there are many others known to those skilled in the art. These solvents may be used in combination with low concentrations of surfactant chemicals which themselves leave little visual residue. Rinse aid surfactants such as poly ethoxy poly propoxy block copolymers and sarcosinates are examples of these.

In a healthcare environment there are a very wide range of surfaces, equipment, and devices which must not only be kept clean, but which must appear clean and not harbour residues that detract aesthetically or functionally from their roles in patient care or cross-infection control. Typically, such items are made of stainless steel, other metals, glass and/or a wide range of plastics and rubbers. They may include screens, keyboards, trays, wheelchairs, trolleys, walls, windows and many diverse pieces of medical equipment and equipment stands, bed frames, mattresses, commodes and furniture.

BRIEF SUMMARY OF THE INVENTION

It is an object of the present invention to provide a wet wipe that leaves a smear-free or substantially smear-free finish which is suitable for use in a healthcare environment and that can be used to clean all of the aforesaid items to a satisfactory standard. Such a wet wipe will comprise a substrate that has been impregnated with an appropriate cleaning composition.

To achieve this object, it is preferred that the cleaning composition is free of organic solvents, such as alcohols, aromatic solvents, or petroleum based spirit solvents, is biodegradable and is capable of the removal of both heavy and light soils from all types of materials while at the same time leaving a substantially smear-free surface. It is desirable to avoid the use of organic solvents in healthcare environments because many of them pose a health hazard and several are highly toxic. They also tend to be inflammable and mixtures of them with air can be explosive. The heavy use of cleaning compositions in healthcare environments therefore makes it preferable to avoid their use entirely, not least to prevent a build-up of their vapours in air. It is also important for the cleaning composition to be safe for use without protective clothing, such as rubber gloves, being required. It should therefore be non-irritating to the skin and mild to eye tissue such that it causes minimal, if any, irritation of these tissues. It should also be stable and capable of being formulated into an aqueous solution.

DETAILED DESCRIPTION OF THE INVENTION

According to the present invention there is provided a wet wipe comprising a substrate that has been impregnated with a cleaning composition, said cleaning composition comprising an aqueous alkyl glucoside and/or alkyl polyglucoside mixture wherein the alkyl glucoside and/or alkyl polyglucoside is present in any amount between 0.01% w/v and 4.00% w/v inclusive.

An alkyl glucoside includes linear or branched chain alcohols, including but not limited to those derived from natural plant oils, fatty alcohols and carbohydrates. Alkyl glucoside and alkyl polyglucoside are nonionic surfactants with excellent detergent properties, being particularly good at removing oily deposits and solubilizing proteins. They are highly environmentally friendly and meet OECD standards for ultimate biodegradability.

Suitable alkyl glucosides and alkyl polyglucosides for use in the present invention are capryl glucoside, decyl glucoside, dodecyl (lauryl) glucoside, tetradecyl glucoside, pentadecyl glucoside, hexadecyl glucoside, and octadecyl glucoside, diglucoside, tri-glucoside, tetra-glucoside, penta-glucoside and hexaglucoside and mixtures of any of the foregoing.

Preferably, the alkyl glucoside and/or alkyl polyglucoside is present in an amount between 0.02% w/v and 2.50% w/v inclusive. Such a quantity strikes a compromise between the composition having sufficient cleaning power and leaving a substantially smear-free surface.

Aqueous alkyl glucosides can show a tendency toward crystallization when stored at room temperatures. This problem is reduced with alkyl glucosides in which the alkyl radical has 16 or fewer carbon atoms. Preferably, therefore, the cleaning composition comprises a C8-C16 alkyl polyglucoside.

Other bio-degradable chemicals which act to enhance the cleaning properties of the wipe by broadening the suitability of the wet wipe for cleaning a wide range of surfaces may also be included in the cleaning composition. Preferably, these chemicals are present in lesser amounts than the alkyl glucosides and also leave no smear or only a minimal smear and include, for example, butoxydiglycol and alkyl dimethyl amine oxide. Preferably, these are present in a quantity of no more than 1% v/w.

Other additives may also be usefully be added in small quantities to the cleaning composition according to the invention. These may comprise one or more disinfectants, stabilizers, preservatives, dyes, fragrances and odour masking agents and mixtures thereof. For example, the disinfectant may comprise phenoxyethanol, which is widely available under the registered trade mark "Nipacide", or an isothiazolinone-derived biocide such as methylchloroisothiazolinone or methylisothiazolinone. These also have the advantage of acting as a preservative of the cleaning composition and of inhibiting microbial growth and mould formation within the stored wet wipe prior to use. Preferably, these disinfectants are present at no more than 0.5% v/w of the cleaning composition.

The substrate that is impregnated with the cleaning composition is preferably a nonwoven material. Suitable nonwoven materials include but are not limited to those types which are binder free so that the binder is not deleteriously affected by the cleaning composition nor itself contributes to smearing. Examples of binder free nonwoven materials include spun laced or hydro-entangled nonwoven materials. However other types such as wet laid, airlaid, thermobond or stitch bonded types may also be used. The wipes may comprise fibres made of any of or a mixture of polypropylene, polyester, polyethylene, viscose, cotton, regenerated wood pulp and cellulose. They may also include micro-fibre and nano-fibre products The substrate is preferably produced in the form of individual tissues or a perforated roll of material from which individual tissues can be separated that are impregnated with the cleaning composition and packaged ready to be dispensed from resealable tubs, buckets, flow-wrap packs or similar. Alternatively, impregnated wipes may be individually sealed in a wrapper made of a suitable packaging material, such as an impermeable foil, cellophane and the like.

Two examples of formulations of cleaning compositions that can be used to impregnate a substrate to produce a wet wipe in accordance with the invention will now be described.

EXAMPLE 1

0.1-1.0% v/w C8-C16 alkyl polyglucoside (CAS No 68515-73-1)
0.1-2.0% v/w butyl polyglucoside (CAS No 68515-73-1)
0.05-1.0% v/w butoxydiglyco (CAS No 112-34-5)
0.01-1.0% v/w alkyl dimethyl amine oxide (CAS No 2605-79-0)
0.2-0.5% v/w phenoxyethanol
Water to 100%

EXAMPLE 2

0.01-2.0% v/w lauryl glucoside (CAS No 68515-73-1)
0.01-2.0% v/w capryl/decyl glucoside (CAS No 68515-73-1)
0.01-1.0% v/w fragrance
0.01-0.1% v/w methylchloroisothiazolinone or methylisothiazolinone
Water to 100%.

The ingredients of these formulations are simply mixed together to form an aqueous cleaning composition that can then be used to impregnate a substrate by soaking the substrate in the composition to thereby produce a wet wipe in accordance with the invention. Such a wet wipe is suitable for cleaning a wide range of surfaces and materials and removing various types and levels of soiling, both organic and inorganic in a manner that leaves substantially no smear, only a minimal smear or a clean smear-free surface.

I claim:

1. A smear-free wet wipe comprising a substrate that has been impregnated with a cleaning composition, said cleaning composition consisting of a mixture of C8-C16 alkyl polyglucoside and butyl polyglucoside wherein said mixture is present in an amount between 0.01% v/w and 4.00% v/w inclusive, butoxydiglycol in a quantity of no more than 1.0 v/w, alkyl dimethyl amine oxide in a quantity of no more than 1.0 v/w, phenoxyethanol in a quantity of no more than 0.5% v/w, and water.

2. The smear-free wet wipe of claim 1, wherein said cleaning composition consists of a mixture of:

from 0.1 to 1.0% v/w inclusive C8-C16 alkyl polyglucoside;
from 0.1 to 2.0% v/w inclusive butyl polyglucoside;
from 0.05 to 1.0% v/w inclusive butoxydiglycol;
from 0.01 to 1.0% v/w inclusive alkyl dimethyl amine oxide;
from 0.2 to 0.5% v/w inclusive phenoxyethanol; and
water being a remainder of the mixture.

3. The smear-free wet wipe of claim 1, wherein the substrate comprises a nonwoven material.

4. The smear-free wet wipe of claim 3, wherein the nonwoven material is binder free.

5. The smear-free wet wipe of claim 3, wherein the nonwoven material is a spun-laced or hydro-entangled nonwoven material.

6. The smear-free wet wipe of claim 1, wherein the substrate comprises fibers selected from the group consisting of polypropylene, polyester, polyethylene, viscose, cotton, regenerated wood pulp, cellulose, micro-fibres, nano-fibres and mixtures thereof.

7. The smear-free wet wipe of claim 1, wherein the substrate is packaged so as to dispensable from a tub, a bucket, a flow-wrap pack or an individually sealed wrapper.

* * * * *